US007722782B2

(12) United States Patent
Coffey et al.

(10) Patent No.: US 7,722,782 B2
(45) Date of Patent: May 25, 2010

(54) PORTABLE HEATING APPARATUS AND METAL FUEL COMPOSITE FOR USE WITH SAME

(75) Inventors: Brendan Coffey, Austin, TX (US); Ramesh C. Kainthla, College Station, TX (US); Charles Edward Sesock, College Station, TX (US)

(73) Assignee: Rechargeable Battery Corporation, College Station, TX (US)

( * ) Notice: Subject to any disclaimer, the term of this patent is extended or adjusted under 35 U.S.C. 154(b) by 450 days.

(21) Appl. No.: 11/486,400

(22) Filed: Jul. 12, 2006

(65) Prior Publication Data

US 2009/0293859 A1 Dec. 3, 2009

Related U.S. Application Data

(60) Provisional application No. 60/595,524, filed on Jul. 12, 2005.

(51) Int. Cl.

| | |
|---|---|
| ***C09K 3/18*** | (2006.01) |
| ***C06B 45/00*** | (2006.01) |
| ***C06B 45/12*** | (2006.01) |
| ***D03D 23/00*** | (2006.01) |
| ***D03D 43/00*** | (2006.01) |

(52) U.S. Cl. ..... 252/70; 149/2; 149/14; 149/109.4

(58) Field of Classification Search ..... 252/70; 149/2, 14, 109.4

See application file for complete search history.

(56) References Cited

U.S. PATENT DOCUMENTS

| | | | | |
|---|---|---|---|---|
| 4,013,061 | A | | 3/1977 | Trumble et al. |
| 4,033,323 | A | | 7/1977 | Trumble et al. |
| 4,043,314 | A | | 8/1977 | Trumble et al. |
| 4,093,424 | A | | 6/1978 | Yoshida et al. |
| 4,199,548 | A | | 4/1980 | Kaiho et al. |
| 4,255,157 | A | | 3/1981 | Yamaguchi et al. |
| 4,522,190 | A | | 6/1985 | Kuhn et al. |
| 4,880,483 | A | | 11/1989 | Baldi |
| 4,895,609 | A | | 1/1990 | Baldi |
| 5,035,230 | A | | 7/1991 | Steidl et al. |
| 5,102,700 | A | | 4/1992 | Baldi |
| 5,269,161 | A | | 12/1993 | Stillwagon |
| 5,464,699 | A | | 11/1995 | Baldi |
| 5,501,751 | A | * | 3/1996 | Baldi et al. ..... 149/14 |
| 5,517,981 | A | | 5/1996 | Taub et al. |
| 5,611,329 | A | * | 3/1997 | Lamensdorf ..... 126/263.07 |
| 5,626,022 | A | | 5/1997 | Scudder et al. |
| 5,935,486 | A | | 8/1999 | Bell et al. |
| 5,984,953 | A | | 11/1999 | Sabin et al. |
| 6,093,498 | A | | 7/2000 | Baldi |
| 6,193,814 | B1 | | 2/2001 | Baldi |
| 6,248,257 | B1 | | 6/2001 | Bell et al. |

(Continued)

*Primary Examiner*—Jerry Lorengo
*Assistant Examiner*—James E McDonough
(74) *Attorney, Agent, or Firm*—Factor & Lake, Ltd.

(57) ABSTRACT

A particulate composite fuel of metal preferably of aluminum for a portable heater. The fuel reacts with oxygen in the air, producing heat. The composite fuel may also be flaked aluminum or iron nanopowder. A portable heater having a fuel mass, at least one thermal conductive member, and at least one insulating member. The heater transfers the heat of the oxidation of the metal particulate fuel to a desired mass to be heated, typically a food item. The multilayered heater also acts as a buffer absorbing released heat and releasing the heat to the desired mass at a rate slower than the absorbing.

16 Claims, 4 Drawing Sheets

U.S. PATENT DOCUMENTS 6,266,879 B1 7/2001 Scudder et al.
6,267,110 B1 7/2001 Tenenboum et al.
6,289,889 B1 9/2001 Bell et al.
6,305,175 B1 10/2001 Searle et al.
6,502,407 B1 1/2003 Searle et al.
6,513,516 B2 2/2003 Sabin et al.
6,601,576 B1 8/2003 Baysinger et al.
6,601,577 B2 8/2003 Bousila
6,663,731 B1 * 12/2003 Rose et al. ..... 149/42
6,705,309 B2 3/2004 Searle et al.
6,943,323 B2 9/2005 Iannuci
6,948,490 B2 9/2005 Searle
6,962,149 B2 11/2005 Kalb
D513,939 S 1/2006 Leonzo
6,986,345 B2 1/2006 Kolb
6,986,435 B2 1/2006 Sagel et al.
7,008,656 B2 3/2006 Zimmerman, Jr. et al.
2003/0121906 A1 7/2003 Abbott et al.
2004/0206346 A1 10/2004 Teneboum et al.

* cited by examiner

PORTABLE HEATING APPARATUS AND METAL FUEL COMPOSITE FOR USE WITH SAME

CROSS REFERENCE TO RELATED APPLICATIONS

This application claims the benefit of U.S. Provisional Application No. 60/595,524, filed Jul. 12, 2005.

GOVERNMENT CONTRACT

The invention contained herein was funded partially by contract numbers W911 QY-06-C-0019 and W91A2K52719010 by the US Army Soldier and Biological Chemical Command and the United States Government may have certain rights to the invention herein.

TECHNICAL FIELD

The present invention relates generally to portable heating applications, such as self contained food heating packages, and to particulate composite fuels that react with the atmospheric oxygen to produce heat.

BACKGROUND AND SUMMARY OF THE INVENTION

Portable chemical heaters with flameless operation are desirable for heating food and various other applications requiring a portable source of heat. For example the United States Army now uses a Flameless Ration Heater (FRH) rather than a portable camp-stove to heat the pre-packaged Meal, Ready-to-Eat (MRE) eight-ounce (227 g) field ration. The FRH consists of a super-corroding magnesium/iron mixture sealed in a waterproof pouch (total FRH weight is approximately 22 grams). To operate the FRH, a pouch is opened in which the MRE is inserted, and approximately 58 grams of water is added to a fuel containing portion of the FRH surrounding the MRE to initiate the following reaction:

$$Mg+2H_2O \rightarrow Mg(OH)_2+H_2$$

Based upon the above reaction of the fuel, the MRE temperature is raised by approximately 100° F. in less than 10 minutes. This is equivalent to a heat transfer rate of approximately 0.2 to 0.75 Watts per gram of food heated (the actual value depending on the heat capacity and the exact time lapse of heating). The maximum temperature of the system is safely regulated to about 212° F. by raising and condensing of steam. The specific energy content of the FRH is approximately 13 kJ per gram of dry magnesium and about 1.3 kJ per gram of total device weight including packaging and water. The current FRH, while effective, produces hydrogen gas as a byproduct generating safety, transportation and disposal concerns, and making it less suitable for use in consumer sector applications where accidental misuse could lead to fire or explosion.

While the currently used Mg—Fe FRH is effective at heating rations, another particular drawback with present military FRH technology is that it requires water to activate. The required water, in addition to being heavy and spacious, is typically obtained from a soldier's drinking water supply, which is often limited. Additionally, present systems also require the soldier to inconveniently add the water as an additional step in the process of activating the FRH.

Other self-heating food packaging products are available in consumer products based on the heat of hydration from mixing "quicklime" (calcium oxide) and water ($CaO+H_2O \rightarrow Ca(OH)_2$) which does not generate hydrogen. With water present the peak temperature is similarly limited to 212° F. but even neglecting the weight of packaging and water, the specific energy of the system is low (approximately 1.2 kJ per gram of CaO). Self-contained systems must also provide some means of mixing the segregated reactants adding complexity and bulk. Measurements on some commercial self-heating packaged food products are shown in Table 1.

TABLE 1

| | Food product (net) | | Total package (gross) | | Specific energy of |
|---|---|---|---|---|---|
| | Weight (g) | Volume (ml) | Weight (g) | Volume (ml) | heater (kJ/g) |
| Coffee | 300 | 295 | 551 | 600 | 0.34 |
| Beef stew | 425 | 481 | 883 | 963 | 0.13 |

While quicklime based heaters may offer greater safety than the Mg based heaters, those heaters which utilize quicklime significantly lower specific energy cause the weight and size of the heater to approach that of the object being heated, reducing portability.

Portable flameless chemical heaters that do not generate hydrogen and with device specific energy content of greater than 0.5 kJ/g are thus desirable. Performance, cost, safety of operation, transportation, storage, and disposal are all desirable requirements of any energy storage/delivery system.

Fuel/air reactions if achieved without flame, can offer an advantage in terms of specific energy per weight, and bulk, since one reactant (oxygen in air) need not be stored in the device. While not typically regarded as fuels, the air oxidation of metals can produce significant amounts of energy as indicated in Table 2. Many common metals including: iron; magnesium; aluminum; zinc; and, tin are classified as combustible.

For comparison purposes, it is noted that the energy content of hydrocarbon fuels is ranked using gross caloric values (GCV); GCV being the energy generated per unit mass on complete combustion. Table 2 shows approximate GCV values for various hydrocarbon fuels or the equivalent enthalpy of formation for the metal oxides of combustible metals. Note for example that the energy content of lithium metal exceeds that of most hydrocarbon fuels and that of aluminum is comparable to alcohol.

TABLE 2

| FUEL | | | |
|---|---|---|---|
| HC | Metals | Reaction Products | Calorific Value (kJ/g) |
| Hydrogen | | H2O | 150 |
| | Lithium | Li2O | 86 |
| Methane | | CO2 & H2O | 55 |
| Kerosene | | CO2 & H2O | 47 |
| Gasoline | | CO2 & H2O | 45-47 |
| Fuel Oil | | CO2 & H2O | 43 |
| Coal | | CO2 & H2O | 26-40 |
| | Aluminum | Al2O3 | 31 |
| Ethanol | | CO2 & H2O | 30 |
| | Magnesium | MgO | 25 |
| Wood | | CO2 & H2O | 16-17 |
| | Zinc | ZnO | 9 |
| | Iron | Fe2O3 | 8 |
| | Tin | SnO | 2 |

Some potential advantages of metal fuels include: high density (compact); solid (no spill or leakage); and, solid reaction products (no emission). These attributes combined with high energy content suggests that metal oxidation reactions may be uniquely suited for use in portable chemical heaters.

There presently remains a need for a portable chemical heater, such as for heating portable food rations such as an MRE, that, among other things, utilizes the high energy content of particulate fuels containing metal.

SUMMARY OF THE INVENTION

The present invention is intended to safely and efficiently harness the oxidation energy of combustible metal particulates in a flameless chemical heater with device energy content greater than 0.5 kJ/g. In one broad aspect of the present invention buffers are provided to release heat to the object or desired mass to be heated at a rate slower than the rate at which the energy of the fuel oxidation is generated. In a preferred embodiment of heating a portable food container, such as an MRE, machine vended coffee or stew, the invention supplies heat to the food container at a desired rate when the temperature of the oxidation reaction of the metal particulate composite fuel is above 500° F.

The present invention also provides composite fuel composition for heating applications, preferably self-contained heating applications, such as an FRH device. However, while the description of the preferred applications of the invention may be directed towards heating food and heaters for food, the present invention is not limited solely to food uses, but is applicable for other uses as well.

In an embodiment of the invention, a heater with the composite particulate fuel is entirely self-contained, i.e., all reactants are contained within a packaging or container to eliminate a need for a consumer to utilize external sources of reagent, e.g., water. The present invention also contemplates packaging that will allow for a metal particulate composite fuel to activate without any addition of reagent supplied by a consumer. The heater of the present invention thus minimizes weight, cost, complexity, and size. In addition, heaters according to the invention are disposable and maintain an extended shelf life. Preferably, the heater packaging and fuel activator maintains their operational capability at temperatures from −25° F. to 120° F. Preferably, all materials of the heater shall be safe for operation, transportation, storage, and disposal.

According to one aspect of the invention, a composite fuel for a portable heater for producing heat for raising the temperature of a desired mass, for example a comestible, by reacting with atmospheric oxygen, is provided wherein the composite fuel comprises at least approximately 70 percent metal by weight. According to another aspect of the invention, a composite fuel is aluminum or iron, or mixtures thereof.

According to another aspect of the invention, a composite fuel further comprises metal oxide, for example manganese dioxide.

According to another aspect of the invention, a composite fuel further comprises inert filler.

According to another aspect of the invention, a composite fuel further comprises spherical alumina powder.

According to another aspect of the invention, a composite fuel for a portable heater for producing heat for raising the temperature of a desired mass, for example a comestible, by reacting with atmospheric oxygen is proved wherein the composite fuel comprises a nano metal.

According to another aspect of the invention, a composite fuel further is flaked aluminum, or iron nanopowder, or mixtures thereof.

According to another aspect of the invention, a portable heater for producing heat for raising the temperature of a desired mass, for example a comestible, is provided comprising a composite fuel mass in thermal contact with at least one thermal conduction member which is in thermal contact with the desired mass and in thermal contact with at least one insulating member which is disposed between the composite fuel mass and the atmosphere; and, one of more openings in the heater to permit ambient oxygen to contact the composite fuel.

According to another aspect of the invention, a portable heater further comprises a heat sink disposed between the composite fuel and the insulating member.

According to another aspect of the invention, the heat sink is one or more metal members not involved with significant heat generation, for example, metal sheets, foils, beads, etc.

According to another aspect of the invention, at least a portion of the composite fuel mass is disposed in a continuous undulated shape.

According to another aspect of the invention, the desired mass is an MRE.

According to another aspect of the invention, a heater is provided in a container, the container having an interior space bounded by an inner surface, the heater having a configuration, starting from a portion, portions or entire inner surface of the container, of: an insulating member being in thermal contact with a heat sink which is in thermal contact with a thermal conduction member which is in contact with the composite fuel which is in thermal contact with a second thermal conduction member which is in thermal contact with a metal thermal conduction member which is in thermal contact with the desired mass.

According to another aspect of the invention, the container inner surface is formed as a flexible pouch, the desired mass is an MRE, and the heater is in two separate segments.

According to another aspect of the invention the insulating member, the heat sink, the thermal conduction member, the composite fuel, the second thermal conduction and the metal thermal conduction member are layers.

According to another aspect of the invention, an apparatus for producing heat for raising the temperature of a desired mass, for example a comestible, is provided comprising: a composite fuel which produces heat by reacting with oxygen from ambient air; the desired mass; and, a buffer disposed between the composite fuel and the desired mass, the buffer absorbing heat from oxidation of the composite fuel at a first rate and releasing the heat to the desired mass at a second rate which is lower than the first rate.

According to another aspect of the invention, the composite fuel is a particulate metal composite.

According to another aspect of the invention, the composite fuel is at least approximately 70% particulate metal by weight.

According to another aspect of the invention, the composite fuel is aluminum.

According to another aspect of the invention, the composite fuel is flaked aluminum.

According to another aspect of the invention, the composite fuel is flaked aluminum and the buffer further comprises: at least a thermal conduction member in thermal contact with the composite fuel and; at least one insulating member in thermal contact with the composite fuel.

According to another aspect of the invention, a portable heater for an MRE is provided comprising: a pouch having a removable portion and having a particulate composite fuel surrounding an opening in the pouch which produces heat by reacting with oxygen from ambient air wherein the particulate composite fuel comprises a particulate metal including aluminum, iron, other metals and mixtures of any two or more of these.

These and other benefits of the present invention will become more readily apparent after a review of the detailed description and preferred embodiment.

DESCRIPTION OF THE PREFERRED EMBODIMENTS

Figure 1:
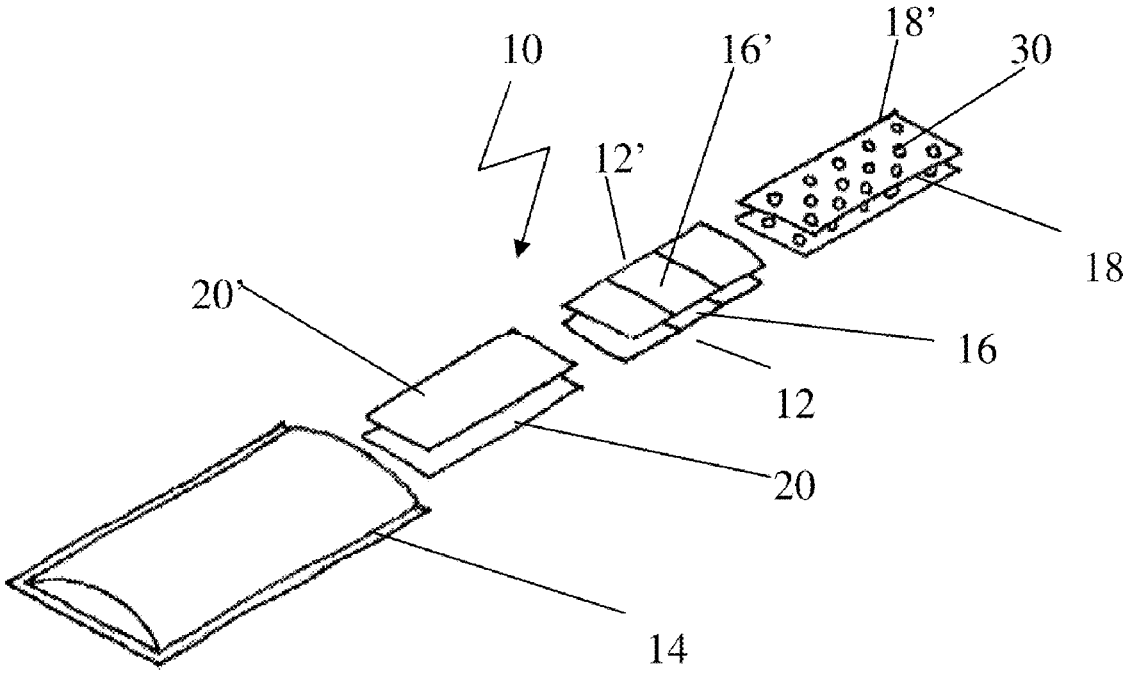
FIG. 1 is an exploded view of two multi-layered heaters of the present invention incorporated into a heating pouch.

While this invention is susceptible of embodiment in many different forms, there is shown in the drawings and will be described in detail below, specific embodiments with the understanding that the present disclosure is to be considered as an exemplification of the principles of the invention and is not intended to limit the invention to the embodiments illustrated.

It should be understood that like or analogous elements and/or components, referred to herein, are identified throughout the drawings by like reference characters. In addition, it should be understood that the drawings are merely a representation, and some of the components may have been distorted from actual scale for purposes of pictorial clarity.

Metal Composite Fuel

An exemplary heater of the present invention utilizes a composite fuel for producing a controlled heat generation by reacting with atmospheric oxygen. The composite fuel comprises at least approximately 70 percent metal by weight. In preferred embodiments the metal is aluminum or iron. In addition to metal, the composite fuel can further include metal oxides or inert fillers.

Various formulations of composite fuel were tested by the applicants and the results of a combustion propagation test and the formulations of the composites are below in Table 3. As related to controlled heat generation, the different times and trends can be understood in terms of the various additives. Fumed silica promotes porosity and oxygen access, which enhances the rate of oxidation. However, in use the composite fuel may be compressed, and the porosity modifier should thus be some other means of promoting oxygen access to the interior composite fuel particles, e.g., a matrix or mesh of fibrous or inert material. As another example of controlled heat generation, manganese dioxide or iron oxide can be used to enhance the availability of oxygen and to control the rate of oxidation. However, metal oxides used as an oxygen source should be used in moderation as they release enormous amounts of energy and can potentially create molten metal. Aluminum oxide can be used as an inert filler which controls the temperature and rate of reaction because of its nonreactive nature. Spherical aluminum, while typically inert, can be used as a slower burning fuel and a thermal conductor (propagation and stabilizing oxidation) within the composite fuel.

TABLE 3

| | Formulation | | | | | |
|---|---|---|---|---|---|---|
| | A | B | C | D | E | F |
| Components | | | | | | |
| Spherical Al Powder | 100% | | 25% | | | 5% |
| AL Flake | | 100% | 75% | 90% | 90% | 70% |
| $Al_2O_3$ (Alumina) | | | | 10% | | |
| $MnO_2$ (Manganese Dioxide) | | | | | | 25% |
| Fumed silica | | | | | 10% | |
| Propagation Time | | | | | | |
| (M:S) | N/A | 3:35 | 3:33 | 4:58 | 2:10 | 0:50 |

A method of determining appropriate rates of oxidation, as shown in Table 3 is an open air propagation test. A line of particulate composite fuel material of standardized dimensions was formed on a Transite sheet and ignited at one end. The time for the reaction zone to travel and fully oxidize the line was recorded. A propagation test, such as the one just described, is one way to determine the appropriate composite formulation. Propagation times can be used in conjunction with other variables to characterize the rate of oxidation and the rate of heating. This type of open air propagation test will give faster and hotter results than an oxygen access restricted packaged heater because the composite fuel has an unrestricted access to air.

As previously disclosed, a composite fuel of the present invention preferably comprises aluminum, which offers a number of benefits with respect to the present FRH technology. The exothermic composite fuel does not contain liquid or nor does it use a liquid activation solution; rather, it is or can be configured to be air-sustained. Using the atmospheric oxygen as an externally available oxidizer improves the specific energy of the device (similarly to metal/air batteries that offer three to four times the specific energy of sealed cells).

The prior art Mg—Fe FRH is based on the accelerated corrosive oxidation of magnesium resulting from dissimilar metals placed in contact with an electrolyte. While the preferred technology of the present invention is also based on a metal oxidation reaction, the underlying physics and chemistry is the accelerated and high-utilization-efficiency oxidation of small particle size, high surface area, metal particles contacted with ambient oxygen.

Nano Metal Fuels

Many common metals including: iron, magnesium, aluminum, zinc and tin, while stable in bulk form (typically oxidation does not extend beyond a protective surface layer), become pyrophoric and by definition spontaneously combust when present as sub-micron scale particles. Combustion and even explosion of industrial metals can be a serious safety hazard in industrial processes where such materials are generated or handled without appropriate consideration of this material property. At the same time there are practical methods by which the combustion of particulate metals can be moderated or extinguished. Controlling oxidation generally involves excluding oxygen and drawing thermal energy out of the combustible metal. A combustible metal can be a practical high-energy content fuel for a heater if a balance point can be found to provide safe, controlled reaction kinetics.

The pyrophoric character is dependent upon the system composition including: metal type, relative concentration of metal, oxidizer, and impurities present, energy inputs such as heat or spark, as well as the particle size distribution of the metal. For example, self-ignition is virtually certain for aluminum particles below 1 micron diameter exposed to air, whereas aluminum particle distributions above a few microns can be handled safely with appropriate procedures. It should be noted, however, that nearly complete oxidation of these slightly larger particles in air can be initiated via an energy input. According to a unique aspect of the composite fuel heater technology of the present invention, preferred embodiments use predominantly flaked aluminum. In addition to being abundant, low-cost, environmentally friendly and food safe, this lightweight metal offers extremely high energy content per unit weight when oxidized.

The standard enthalpy of combustion per unit mass of metal for aluminum of 7.4 kcal/g is higher than that of magnesium. Moreover, in the FRH/MRE context, the prior art Mg—Fe heater alloy is 5 atomic % or approximately 20 wt % iron. While in principle the iron can also be oxidized, it tends to act cathodically to accelerate magnesium oxidation. The activating saline solution also contributes mass. Furthermore the conversion efficiency of the magnesium is reduced by the buildup of reaction products and availability of chloride ion. All of these factors contribute to a lowering of the practical specific energy of the Mg—Fe heater.

In another embodiment of the present invention, the composite fuel is a nano metal. Also, nano scales do apply to the term "nano" herein. More preferably, as used herein, nano metal is generally but not always meant to mean a metal that is reduced in size to between 5 microns to less than 1 micron. "Nano" sized particulates are believed to lower the energy required to initiate and sustain oxidation of the metal by atmospheric oxygen.

The preferred nano metal is flaked aluminum or submicron iron or iron nanopowder. One method of producing the flaked aluminum of the present invention begins with commercially available 7 micron spherical aluminum powder. The aluminum powder is subjected to a ball milling in organic solvents (such as mineral spirits or hexane). This process reduces both the particle size of the aluminum powder and the oxide film thickness. This produces a refined flake-like nano metal with a substantially lower activation energy (around 500 degrees Fahrenheit) than that of larger sized aluminum particles.

A method of producing the iron nanopowder begins with precipitating iron hydroxide from any soluble iron salt, i.e., iron chloride or iron sulfate, by adding ammonium or potassium hydroxide. The precipitate iron hydroxide is further reduced with hydrogen at a temperature between 300-500 degrees Celsius. Another method of producing the iron nanopowder begins with reducing a solution of any soluble iron salt, i.e., iron chloride or iron sulfate, with potassium borohydrate. The precipitate is further reduced with hydrogen at a temperature between 300-500 degrees Celsius.

With sufficient mass, aluminum powder based fuel burning in air can reach temperatures in excess of 2500° F. Thus, to achieve a controlled heat generation, a careful balance of the metal fuel material and the rate of heat transfer from the oxidizing aluminum are needed. One approach to achieving this controlled heat generation is through determining a target-temperature. The current Mg—Fe FRH is intrinsically limited to approximately 212° F., so for the composite fuel used for an FRH application a target temperature of approximately 250° F. is preferred. An application requiring a higher or lower operating temperatures would have different composition of materials in the composite fuel or the heater apparatus.

The formulation F, from Table 3, was compared with a standard Mg—Fe FRH heater with a calorimetric test. A two inch diameter copper tube with one end capped, approximately 10 inches long, was immersed in a stirred water bath. The stirred water bath was placed inside of an insulated plastic tube. First, the Mg—Fe powder (12 g) from a standard FRH was placed in the copper tube. The necessary two ounces of water (59 g) was added and the temperature change of the water bath was recorded. Second, eight (8) grams of formulation F, from Table 3, was placed inside of the copper tube. The reaction was initiated with glycerin, which will be described in more detail below, and the temperature change of the water bath was recorded.

The first order approximation of both reactions was normalized to the mass of the reactants. The Mg—Fe reaction produced 0.975 kcal/g (not taking into account the mass of the water as a reactant). The formulation F of the present invention produced 1.2 kcal/g. As shown, formulation F has a very comparable and competitive energy content. If the mass of the water required in the Mg—Fe FRH is taken into account, the comparable energy content of formulation F is even greater.

The composite fuel approach enables many degrees of freedom in developing an exothermic material to meet the multiple constraints of the FRH application. As noted, in a preferred embodiment, aluminum is the metal fuel material. A metal such as tin could also be utilized in such an arrangement. Tin is low cost, food safe and can provide good thermal conductivity to the matrix. Tin also has a low melting point at 231° C., which may permit some storage of thermal energy as latent heat. Tin also suppresses hydrogen generation. Fumed silica or fumed alumina can be utilized as porosity modifiers, each being voluminous agglomerates of nano-particles. Both materials are inert, thermally stable and food contact safe. In powder form they have extremely low bulk density and are used in a wide variety of applications as thixotropic agents. It should be recognized that the optimal composition of the exothermic particulate metal composite fuel can be determined by experimental development, and accordingly, substitution of these and other components can be made to achieve certain properties.

Initiation of the Composite Fuel

Because in some preferred embodiments the composite fuel as a whole is not pyrophoric, enough energy needs to be provided to initiate the oxidation of the composite fuel. The initiation of the heat producing oxidation reaction of the metal can preferably be initiated by a first initiating reaction.

The first or initiating reaction may be sufficient if the composite is more pyrophoric or sufficiently sized aluminum. However, the first reaction may be used to start only an intermediate reaction.

One commercially available heater utilizes iron particles, salt water, activated carbon and vermiculate to produce a controlled heat reaction. The peak temperature of this system was found to be approximately 170 degrees Fahrenheit. However, this reaction alone will not provide enough heat to initiate the oxidation of the composite fuel and a reaction intermediate is needed.

One intermediate reaction can utilize potassium hydroxide reacting with aluminum. A pellet of potassium hydroxide can be encapsulated in paraffin wax. The wax can be melted at an appropriate temperature, thus exposing the potassium hydroxide to the aluminum. The aluminum and potassium hydroxide react exothermically and produce enough heat to initiate the oxidation of the composite fuel of the present invention.

Another known intermediate can be potassium permanganate and glycerin. The glycerin can be encapsulated in wax. When the wax melts, the glycerin will react with the potassium permanganate. This reaction will create sufficient heat to initiate the oxidation of the aluminum. If the temperature is too low so as to increase the viscosity of the glycerin (freezing point of 64° F.), alcohol can be used to accomplish the same reaction with the permanganate.

Another way to initiate aluminum oxidation directly is with pyrophoric iron. Pyrophoric iron can be tailored with a defined response time and peak temperature to initiate the aluminum oxidization. Preferably a self contained iron squib would be a simple single stage initiation device that could be utilized. The self contained iron squib would not be as prone to unintentional activation at elevated temperatures. The iron squib would be self contained, and upon selectively opening the package, the iron squib would oxidize and provide enough to initiate the oxidation of the fuel. Additionally, pyrophoric iron can be mixed with the aluminum throughout the particulate composite fuel.

Heater Construction

Beyond formulating a composite fuel and initiating the oxidation of the particulate fuel, the present invention is also directed towards the heater construction. The device of the present invention can comprise any form factor, including existing form factors of known heaters. Typically, the device will include container or pouch with an interior space to hold the exothermic fuel and heater therein. The container of the device of the present invention includes an air passage to allow oxygen flow into the device upon activation. The air passage can take many different forms, but can be one or more perforations in the device. The air inlet can alternatively be a removably attached cover, or tear-off portion. The cover can comprise a thin sheet of adhesive backed material in a pull tab form, which will allow easy removal for activation of the heater. One preferred embodiment will be described in more detail with reference to the accompanying figures.

Figure 2:
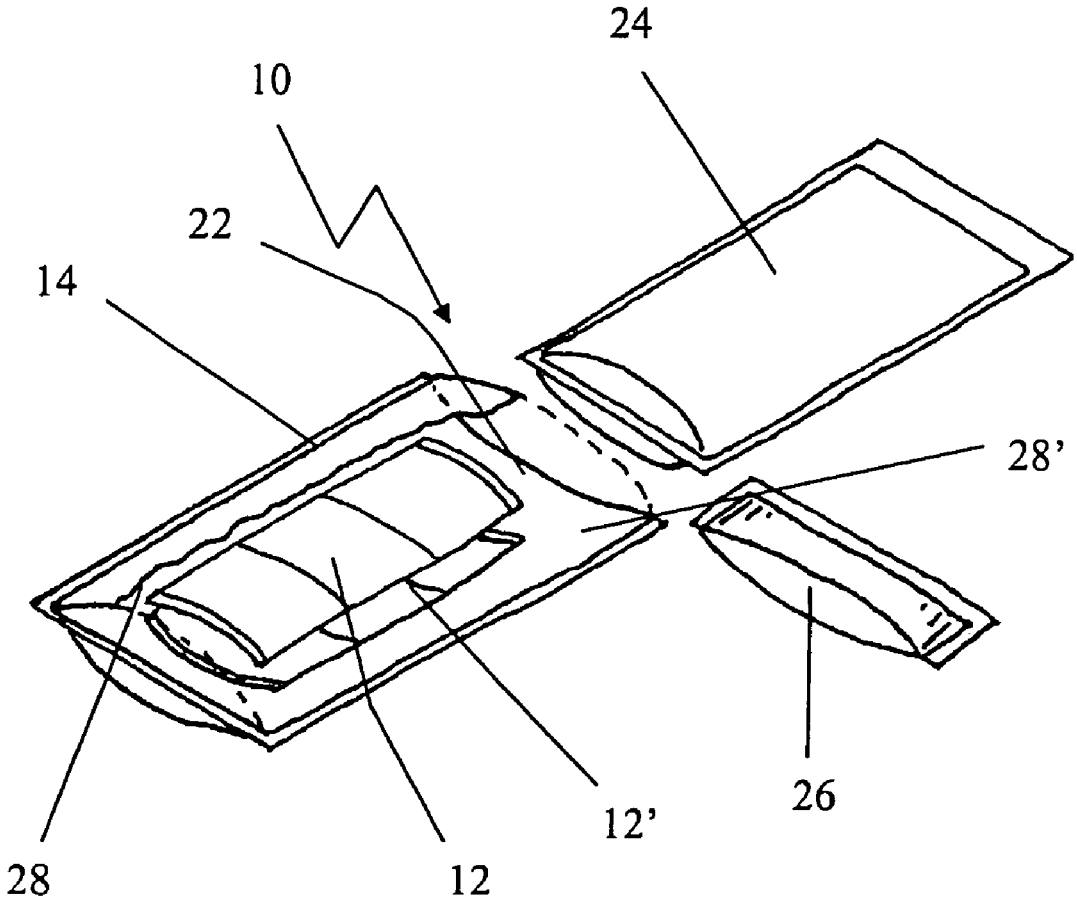
FIG. 2 is a cutaway view of two multi-layered heaters of the present invention inside walls of the pouch.

A portable ration heater 10 has a container 14 enveloping two heaters 12, 12'. The container 14 is preferably a foil laminate pouch and has a tear-off top seal 26, but the container 14 can be any form of container known in the art such as for example a box, can, tube or envelope. Preferably, the heaters 12, 12' are adhered to the container 14 and more preferably the heaters 12, 12' are adhered to an inner surface 28, 28' of an interior cavity 22 of the container 14. Each multilayered heater 12, 12' includes, composite fuel mass 16,16', a thermally conductive member 18, 18', and insulating member 20, 20' and openings 30, 30'. FIGS. 1 and 2 depict two multilayered heaters 12 and 12'. It is contemplated that optionally only one heater 12, 12' may be used depending on the mass and content of the MRE 24.

Figure 3:
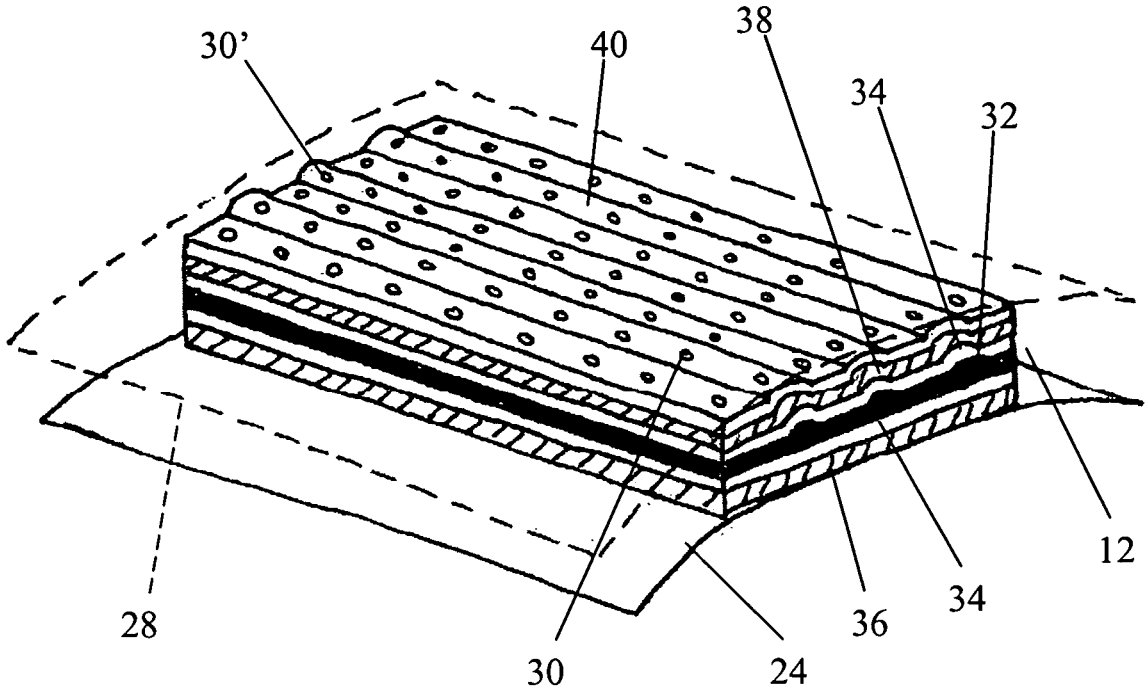
FIG. 3 is a perspective view of a preferred embodiment of a multilayered heater.

In FIG. 3 a heater 12 which a specific layering configuration is shown and will be described in more detail. The heater 12 is preferably adhered to an inner surface 28 of a container 14. The heater 12 can have, starting from the inner surfaces 28, 28' of the interior cavity 22 of the container 14, a configuration of an insulating member 40, a heat sink 38, a thermal conductive member 34, a fuel mass 32, a second thermal conductive member 34, and a metal conductive member 36. The metal conductive member 36 and heat sink 38 can be welded together to give the heater 12 added mechanical integrity. Preferably all of the members have a layered configuration and adjacent members or layers are in thermal contact.

Figure 4:
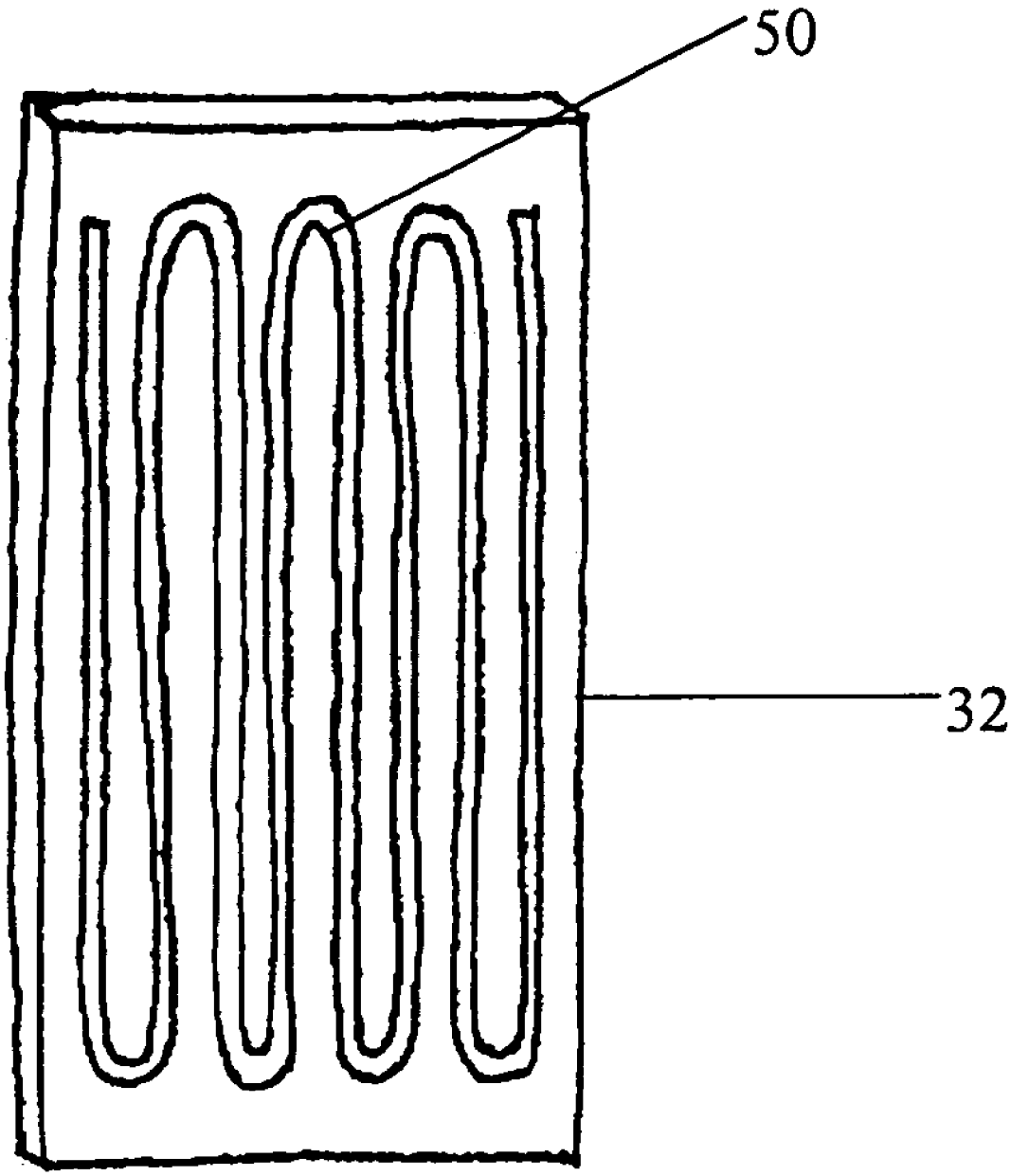
FIG. 4 is a front schematic view of an alternate embodiment for a fuel layer of a heater of the present invention.

The fuel mass 32 houses can be comprised of the fuel, or alternatively, can be designed to house the fuel. One such embodiment, where the fuel mass 32 is housed is shown in FIG. 4, where the fuel mass 32 has a particulate composite fuel arranged in an undulated shape 50. As used herein, undulated shape is meant to mean an elongated configuration such as the one embodiment disclosed. Such undulated shape of the particulate metal composite fuel can optimize reaction time as well as energy transfer. Other undulated shaped configurations can be elongated lines, spirals, circles, crosses, asterisks, grids or any other elongated shape that increases the oxidation of the composite fuel.

Preferably a thermal conductive member 34 is provided on both sides of the fuel mass 32. The thermal conductive member 34 can be painted onto the sides of the metal conductive member 36 and heat sink 38. The thermal conductive member 34 preferably possesses high value for both thermal conductive and heat capacity to prevent localized overheating. Thin coatings of mixtures of aluminum or metal oxide in a polymer binder can be effective as a thermal conductive member 34.

The metal conduction member 36 can be the layer in contact with the desired mass 24, in this embodiment an MRE, when placed in a container 14 or other package employing a heater 12. The metal conduction member 34 can be, for example, a 2-3 mm thick metal foil, either aluminum or steel.

The heat sink 38 is a porous layer preferably formed from pierced or perforated metal foils with openings 30, 30' that are corrugated along their length to provide air channels between the heater 12 and inner surface 28 of the container 14. Heat will transfer from the fuel mass 32 by both conduction through the metal and convection of hot gases in the openings 30, 30' of the heat sink 38. The heat sink 38 can be designed to trap heat and conduct the heat back towards the MRE 24.

An insulating member 40 is adjacent to the inner surface 28 of the container 14. The insulating member 40 is preferably a porous coating of powdered alumina, or other material of low thermal conductivity in a polymer binder and should be of sufficient thickness to minimize heat lost and local overheating of the heater 12.

Experimentally it has been determined that only the layers on one side of the heater need to be porous and preferably the layers between the container and the fuel are the porous layers. This would allow the layers between the fuel mass and the desired mass, i.e., MRE, to be more dense and solid. The porosity of the outer surfaces allow for gas transport, since the reaction providing the heat is the oxidation of the fuel with atmospheric oxygen.

The non-metallic layers can be multi-component composites of various formulations held together by binders. Such non-metallic layers can be applied to the metal layers by painting or coating the formulations on the metal layers. The non-metallic layers can be either organic (polymer) or inorganic (ceramic or clay). Preferably, an alumino-silicate clay is mixed with wood pulp and fired to create porosity. The fuel can then be applied to the resulting clay sheet.

According to another aspect of the invention a buffer absorbs the high amount of heat released from the oxidation of the composite fuel and releases the heat slower than the rate of absorbing the heat into an object to be heated. In the embodiment described above in reference to FIG. 3, the thermal conductive member 34 and the metal conductive member 36 are the buffer. The thermal conductive member 34 and the metal conductive member 36 absorb the heat released by the oxidation of the composite fuel in the fuel mass 32. The metal conductive member 36 transfers heat to the MRE 24. Thus, the metal conductive member 36 acts to absorb the high amount of energy released, and slower than the rate of absorbing the heat, release the heat into an object to be heated 24.

Moreover, it is contemplated that the buffer can be located other than in between the composite fuel and the object to be heated. For example, in FIG. 3, the insulating member 40, heat sink 38, thermally conductive member 34 and metal conductive member 36 also act as a buffer. As the composite fuel oxidizes, heat is released in the direction toward the inner surface 22 of the container 14, i.e., away from the object to be heated. The heat is absorbed by the heat sink 38 and some heat can transfer back to the metal conductive layer 36. Again, the layers act to absorb the high amount of energy released, and slower than the rate of absorbing the heat, release the heat into an object to be heated 24.

According to another aspect of the invention, a quantity of water sufficient to provide a desired steam pressure in the heater may be provided by utilizing a dehydrateable material as a separate layer or as a constituent within an existing layer. A chemical hydrate could provide water molecules that could be released by a chemical reaction from the absorbing of heat. The resultant molecules could exist as steam or phase change into steam, with the steam acting to transfer energy as well as regulate the temperature of the air in the container.

WORKING EXAMPLE

Two test heaters were constructed that measure 2 inches by 4½ inches. The heaters had a metal conduction layer that was a 0.005 inch copper foil. A section of 0.002 inch perforated steel was used as the heat sink. The metal conduction layer was spot welded to the porous heat sink. A woven fiberglass mat approximately 0.040 inches thick was used as an insulating layer.

Approximately 5.0 g of a particulate composite fuel mixture (Table 1, F) was filled between the metal conducting layer and the metal heat sink. One heater was affixed to one side of a test pouch, and the second heater affixed to another side of the test pouch with aluminum tape. Each individual heater was initiated with using the potassium permanganate/glycerin initiation described herein.

Eight ounces of water in the test pouch showed an increase of approximately 70° F. The fuel was consumed in approximately 45 seconds and the peak in water temperature occurred in approximately two minutes with the heaters absorbing heat and releasing heat to the water at a slower rate than the rate of absorbing the heat.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A portable heater for producing a controlled heat generation for raising the temperature of a desired mass, for example a comestible, comprising:

a composite fuel mass in contact with at least one thermal conduction member which is in contact with the desired mass and in contact with at least one insulating member disposed between the composite fuel mass and the atmosphere; and, one of more openings in the heater to permit ambient oxygen to contact the composite fuel.

2. The portable heater of claim 1 further comprising:

a heat sink disposed between the composite fuel and the insulating member.

3. The portable heater of claim 2 wherein the heat sink is metal.

4. The porous heater of claim 1 wherein at least a portion of the composite fuel is disposed in a continuous undulated shape.

5. The portable heater of claim 1 wherein the desired mass is an MRE.

6. The porous heater of claim 1 being provided in a container, the container having an interior space bounded by a inner surface, the heater having a configuration starting from the inner surface of the container of:

the insulating member being in contact with a heat sink being in contact with a thermal conduction member being in contact with the composite fuel being in contact with a second thermal conduction member being in contact with a metal conduction member being in contact with the desired mass.

7. The portable heater of claim 6 wherein the container is a pouch and the desired mass is an MRE.

8. The porous heater of claim 1 wherein the composite fuel comprises at least 70 percent aluminum by weight.

9. The portable heater of claim 6 wherein the insulating member, the heat sink, the thermal conduction member, the composite fuel, the second thermal conduction and the metal conduction member being layers.

10. An apparatus for producing a controlled heat generation for raising the temperature of a desired mass, for example a comestible, comprising:

a composite fuel which produces heat by reacting with oxygen from ambient air;

the desired mass; and, a buffer disposed between the composite fuel and the desired mass, the buffer absorbing heat from oxidation of the composite fuel at a first rate and releasing the heat to the desired mass at a second rate which is lower than the first rate.

11. The apparatus of claim 10 wherein the composite fuel is a particulate metal composite.

12. The apparatus of claim 10 wherein the composite fuel is at least approximately 70 percent particulate metal by weight.

13. The apparatus of claim 10 wherein the composite fuel is aluminum.

14. The apparatus of claim 10 wherein the composite fuel is flaked aluminum.

15. The apparatus of claim 10 wherein the composite fuel is flaked aluminum and the buffer further comprising:

at least thermal conduction member in contact with the composite fuel and;

at least one insulating member in contact with the composite fuel.

16. A portable heater for an MRE comprising: a pouch having a removable portion and containing a particulate composite fuel which produces heat by reacting with oxygen from ambient air wherein the particulate composite fuel is a mixture of aluminum and pyrophoric iron.

* * * * *